US011821426B2

(12) United States Patent
Stanca et al.

(10) Patent No.: US 11,821,426 B2
(45) Date of Patent: Nov. 21, 2023

(54) PROGRESSIVE CAVITY PUMP

(71) Applicant: Henkel IP & Holding GmbH, Duesseldorf (DE)

(72) Inventors: Nicholas E. Stanca, Westlake, OH (US); Ben Parker, Chardon, OH (US); Jess P. Carlson, Chagrin Falls, OH (US); Robert C. Allen, Richmond Heights, OH (US); Paul D. Stephens, Twinsburg, OH (US); David M. Pehar, Willoughby, OH (US)

(73) Assignee: Henkel AG & Co. KGaA, Duesseldorf (DE)

( * ) Notice: Subject to any disclaimer, the term of this patent is extended or adjusted under 35 U.S.C. 154(b) by 138 days.

(21) Appl. No.: 17/245,289

(22) Filed: Apr. 30, 2021

(65) Prior Publication Data

US 2021/0246897 A1 Aug. 12, 2021

Related U.S. Application Data

(63) Continuation of application No. PCT/US2019/058800, filed on Oct. 30, 2019.

(60) Provisional application No. 62/752,623, filed on Oct. 30, 2018.

(51) Int. Cl.

| | |
|---|---|
| ***F04C 2/107*** | (2006.01) |
| ***B05B 11/10*** | (2023.01) |
| ***F04C 15/00*** | (2006.01) |

(52) U.S. Cl.
CPC ..... *F04C 2/1073* (2013.01); *B05B 11/1033* (2023.01); *F04C 15/0065* (2013.01)

(58) Field of Classification Search
CPC . F04C 2/1073; B05B 11/1033; B05B 11/1029
See application file for complete search history.

(56) References Cited

U.S. PATENT DOCUMENTS

| | | | | |
|---|---|---|---|---|
| 6,460,734 | B1 * | 10/2002 | Schroeder | B67D 1/0079 222/383.2 |
| 7,735,688 | B2 * | 6/2010 | Foster | B05B 11/3059 222/153.13 |
| 10,040,083 | B2 * | 8/2018 | Barenhoff | B05B 11/0056 |
| 2008/0083783 | A1 * | 4/2008 | Nelson | B05B 11/3059 222/190 |
| 2009/0261121 | A1 * | 10/2009 | Varga | G01F 11/00 222/325 |
| 2014/0326753 | A1 * | 11/2014 | Turner | B05B 11/103 222/383.2 |

FOREIGN PATENT DOCUMENTS

| | | | | |
|---|---|---|---|---|
| DE | 102018001684 | A1 * | 9/2018 | |
| WO | 2004039695 | | 5/2004 | |
| WO | 2005120719 | | 12/2005 | |
| WO | WO-2016057294 | A1 * | 4/2016 | A45D 44/00 |

OTHER PUBLICATIONS

Machine translation of DE-102018001684-A1.*
Machine translation of WO-2016057294-A1.*
PCT International Search Report issued in connection with International Application No. WO PCT/US2019/058800—dated May 18, 2020.

* cited by examiner

*Primary Examiner* — Jeremy Carroll
(74) *Attorney, Agent, or Firm* — Steven C. Bauman

(57) ABSTRACT

This disclosure relates to pumps and, more particularly, to progressive cavity pumps.

8 Claims, 25 Drawing Sheets

PROGRESSIVE CAVITY PUMP

FIELD

This disclosure relates to pumps and, more particularly, to progressive cavity pumps.

BACKGROUND

Progressive cavity pumps generally are fairly large and include either a flexible shaft or a universal joint, making the pumps prone to failure.

DETAILED DESCRIPTION

Figure 1:
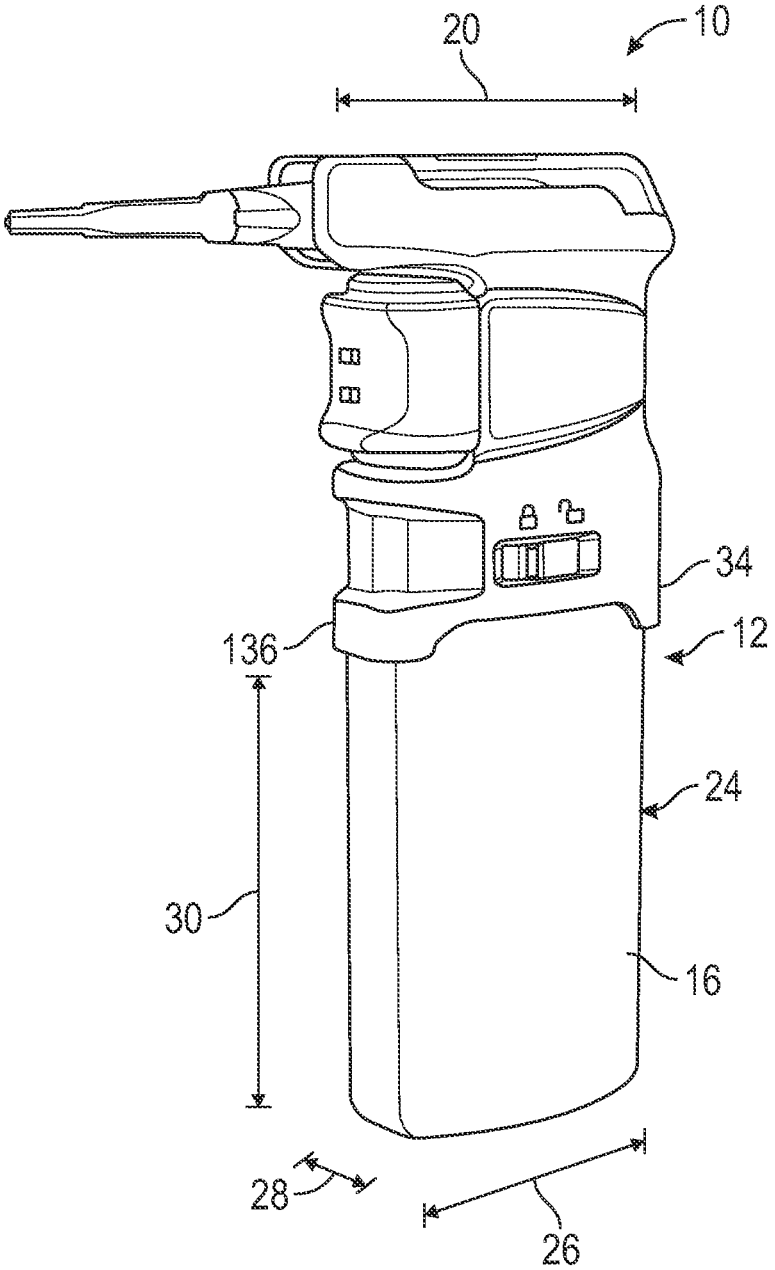
FIG. 1 is a perspective view of a progressive cavity pump disposed on a bottle in a regular orientation position.
Figure 2:
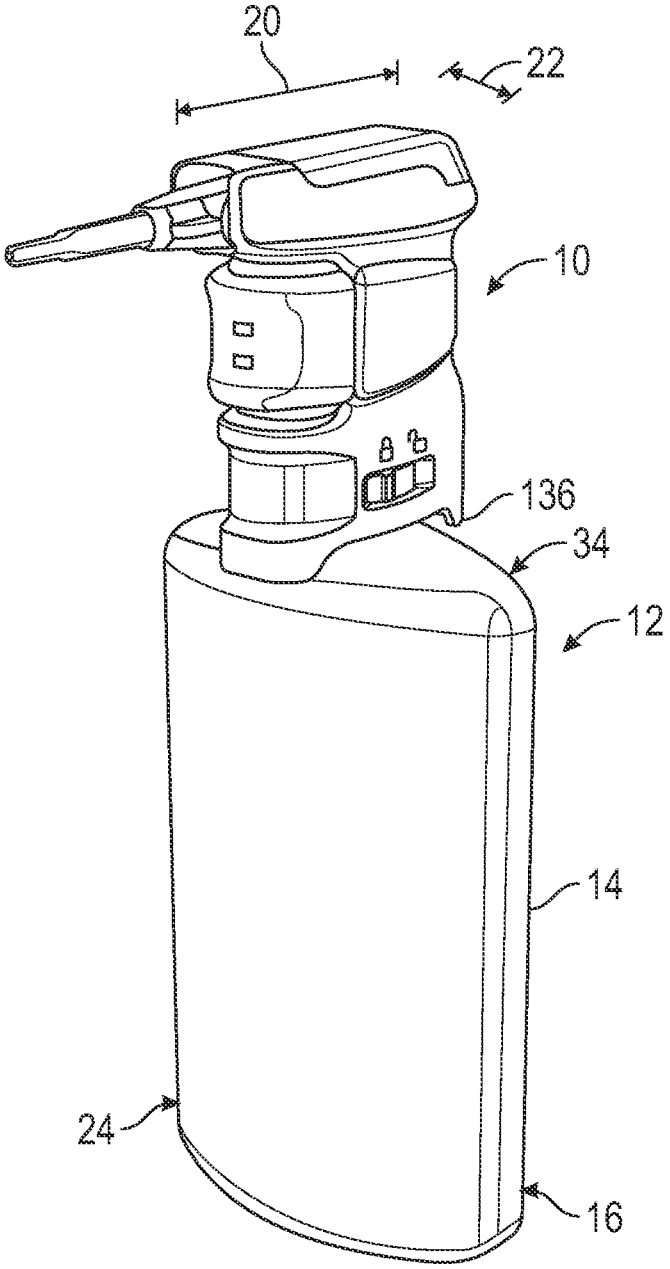
FIG. 2 is a perspective view of the progressive cavity pump of FIG. 1 disposed on a bottle of different size in a transverse orientation position.

Referring to FIGS. 1 and 2, a progressive cavity pump 10 is attached to a small bottle 12 in and to a larger bottle 14, respectively, for dispensing a liquid product 16 from each of the bottles. The pump 10 extends in a longitudinal direction 20 and a transverse direction 22, and is attached to the small bottle 12 in the longitudinal orientation position and to the large bottle 14 in a transverse orientation position, respectively.

Figure 3:
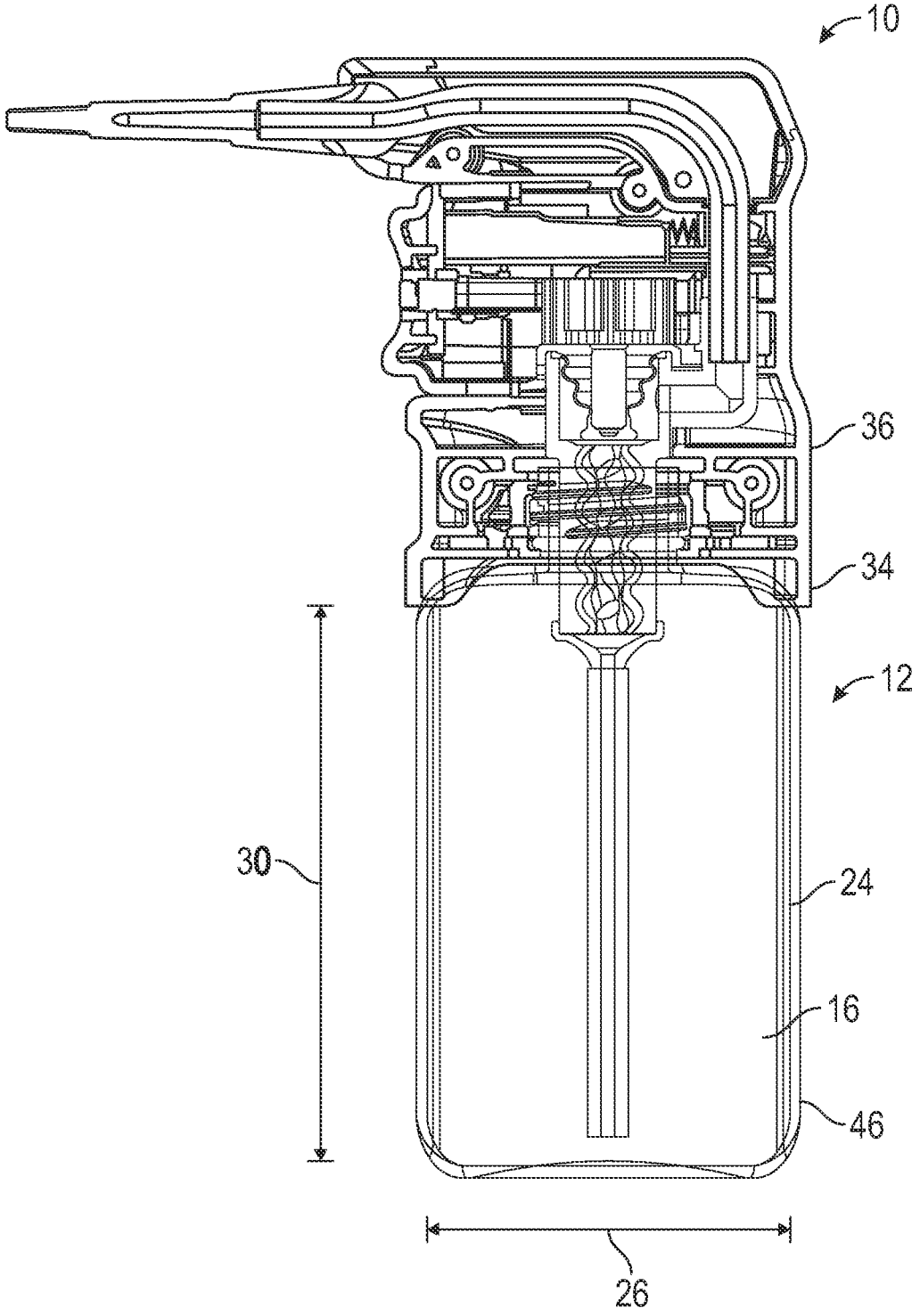
FIG. 3 is a sectional view of the progressive cavity pump and the bottle of FIG. 1.
Figure 4:
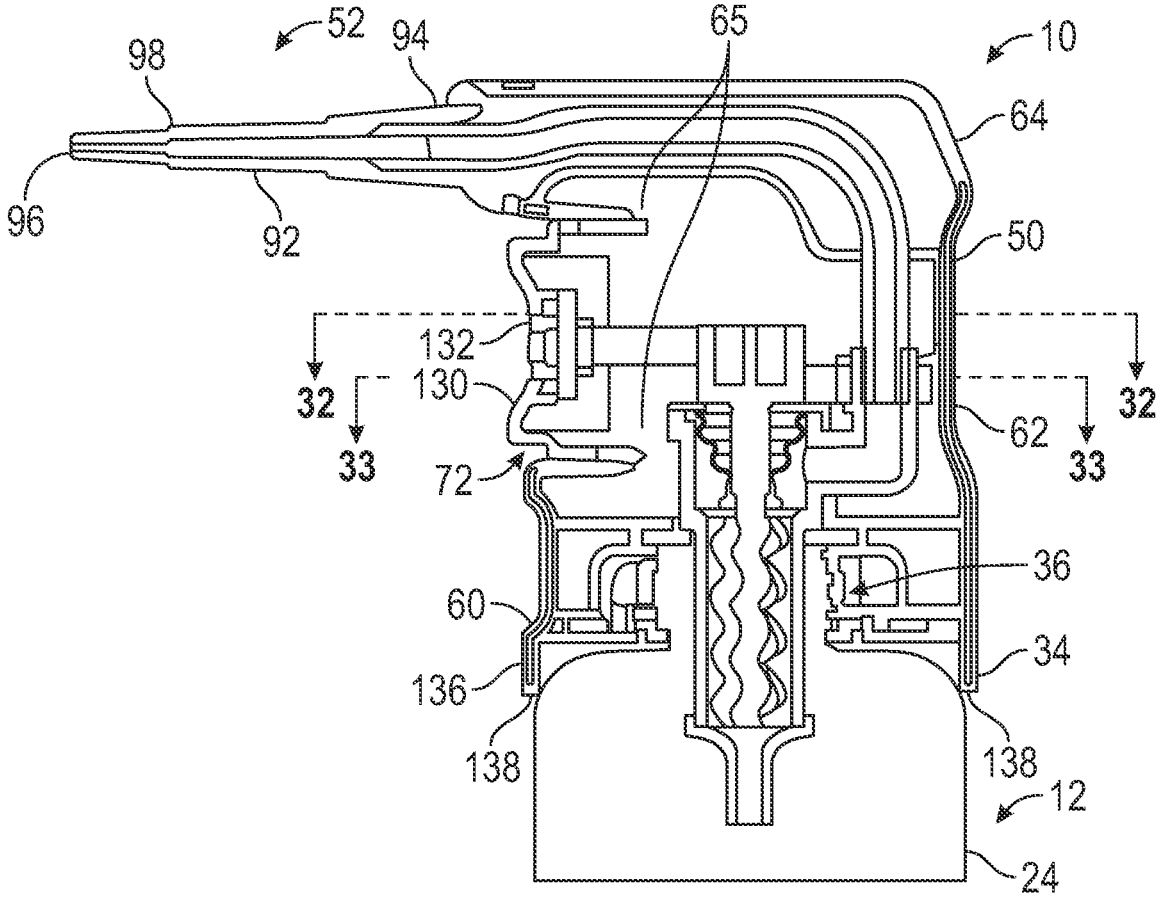
FIG. 4 is an enlarged, partial view of the progressive cavity pump and the bottle of FIG. 3.
Figure 5:
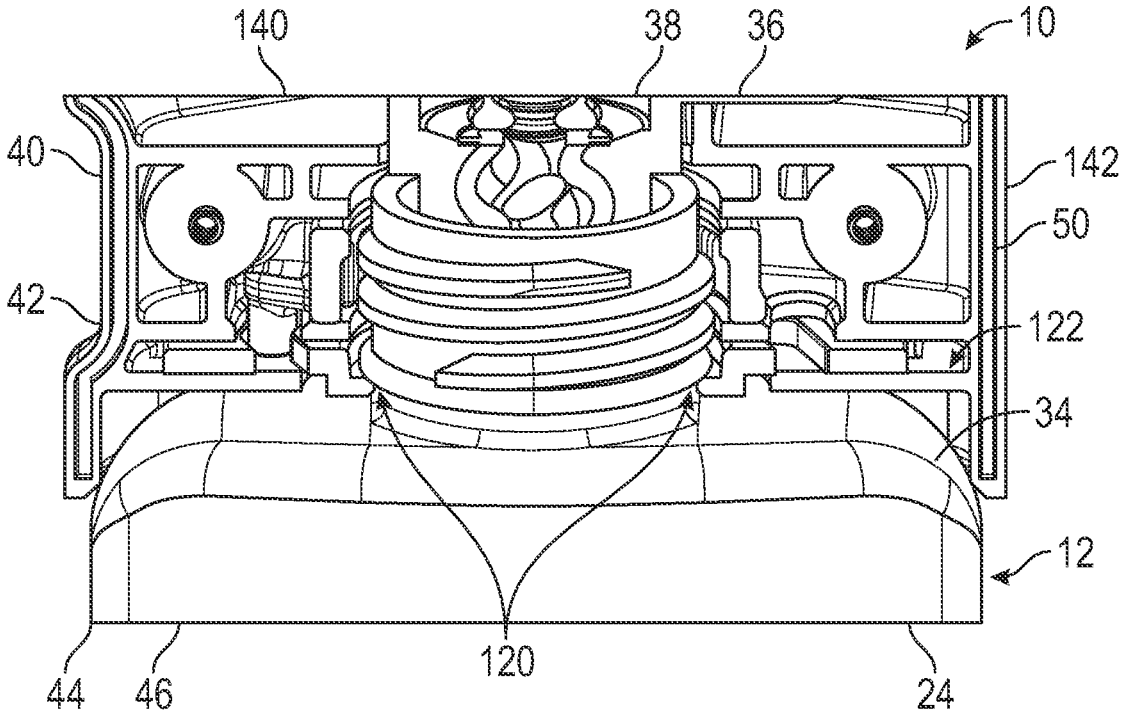
FIG. 5 is an enlarged, partial, perspective view of the progressive cavity pump and the bottle of FIG. 4.

Referring to FIGS. 3-5, each bottle 12, 14 includes a bottle body 24 having bottle width 26, bottle depth 28 and bottle height 30. The bottle body 24 includes a bottle shoulder surface 34 with a bottle neck 36 extending therefrom. The bottle neck portion 36 terminates in a bottle opening 38 with outer threading 40 disposed on an outer surface 42 of the neck 36 and having a bead 44 disposed adjacent to the threading 40. The bottle 12 forms a bottle interior 46 to accommodate the liquid product 16 therein.

Figure 6:
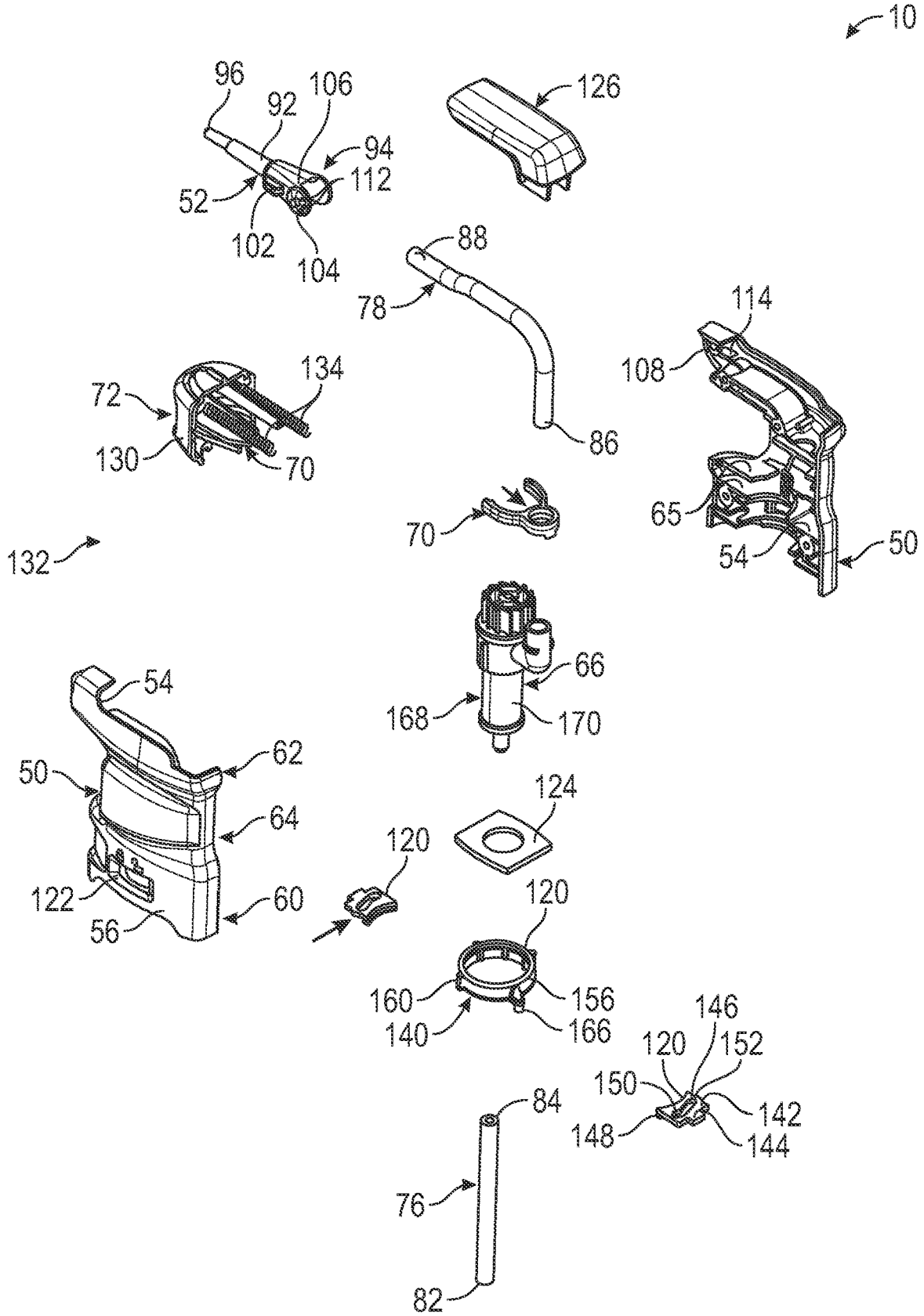
FIG. 6 is an exploded, perspective view of the progressive cavity pump of FIG. 1.

Referring to FIGS. 4 and 6, the pump 10 includes a pump housing 50 with a pump nozzle 52 extending therefrom. The pump housing 50 includes a housing inner surface 54 and a housing outer surface 56 and forms a shoulder portion 60 and an upper portion 62 with the housing mid portion 64 extending therebetween. The inner surface 54 includes a plurality of pump housing features 65 for affixing various assemblies within the pump housing 50. The pump housing features 65 include ribs, grooves, channels and similar features to secure various assemblies, subassemblies and tubes therein. The pump housing 50 supports a progressive cavity pump assembly 66 driven by a drive mechanism 70. A trigger assembly 72, to be engaged externally by the operator of the pump 10, activates the drive mechanism 70 for advancing the liquid product 16 through the pump 10. A flow path 74 for delivering the liquid product 16 is formed by a lower tube 76 extending from the bottle interior 46 into the pump 10, through the pump assembly 66 and through an upper tube 78 into the nozzle 52. The lower tube 76 includes a lower tube inlet 82 open to intake the liquid product 16 and a lower tube outlet 84 for delivering the liquid product to the pump assembly 66. The upper tube 78 includes an upper tube intake 86 connected to the pump assembly 66 and an upper tube outlet 88 disposed in the nozzle 52 for dispersing the liquid product 16 from the pump 10.

Figure 7A:
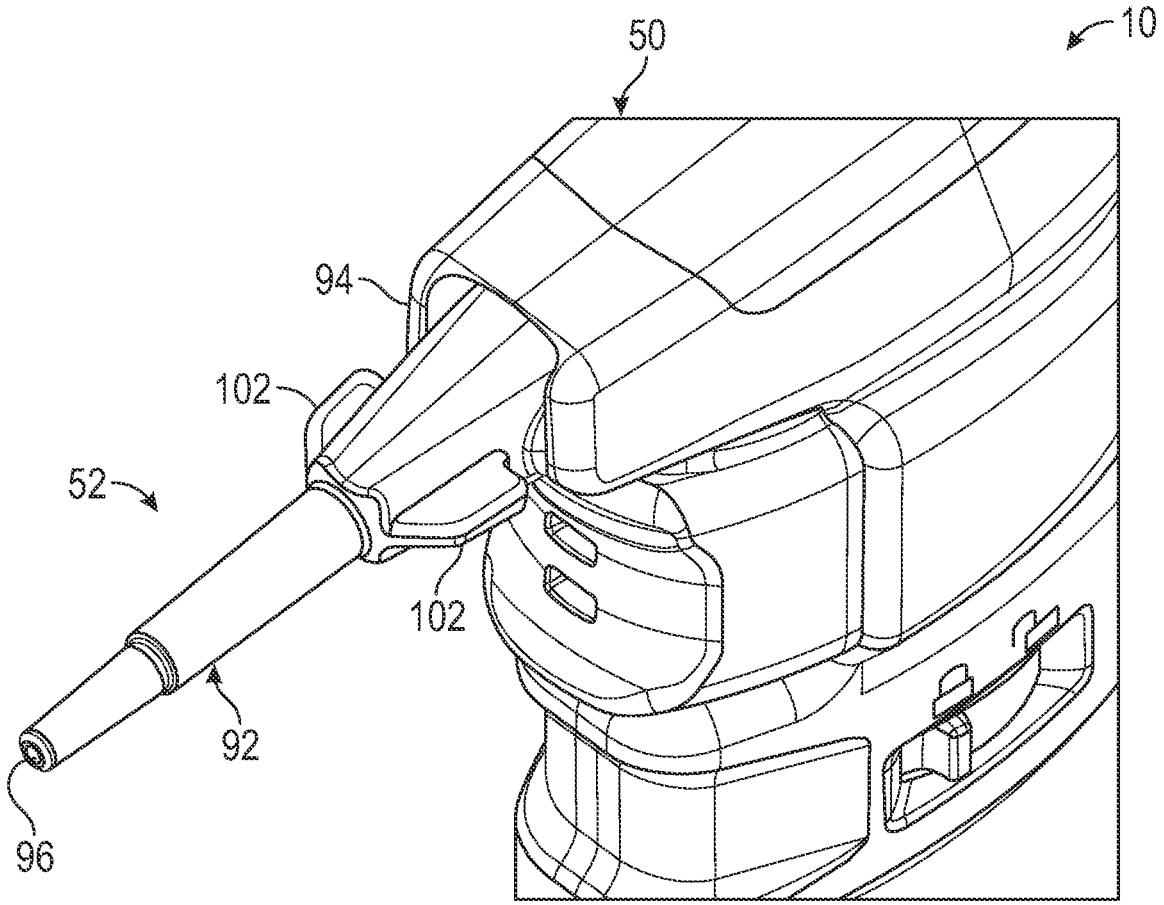
FIGS. 7A and 7B are enlarged, partial, perspective view of a pump nozzle of the progressive cavity pump of FIG. 6.
Figure 7B:
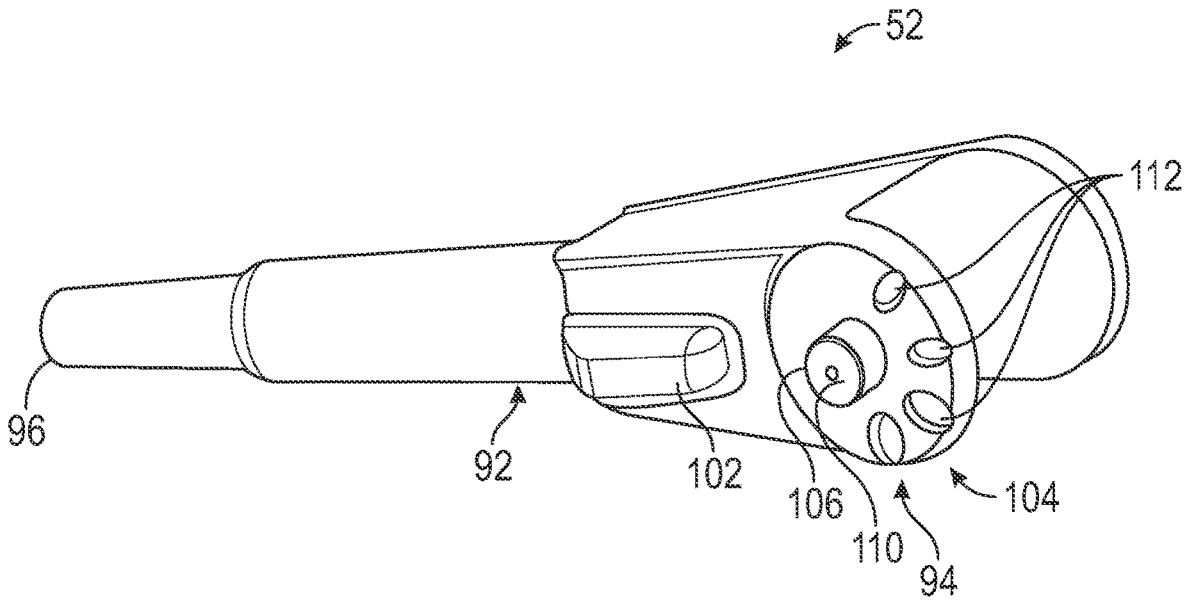
Figure 8A:
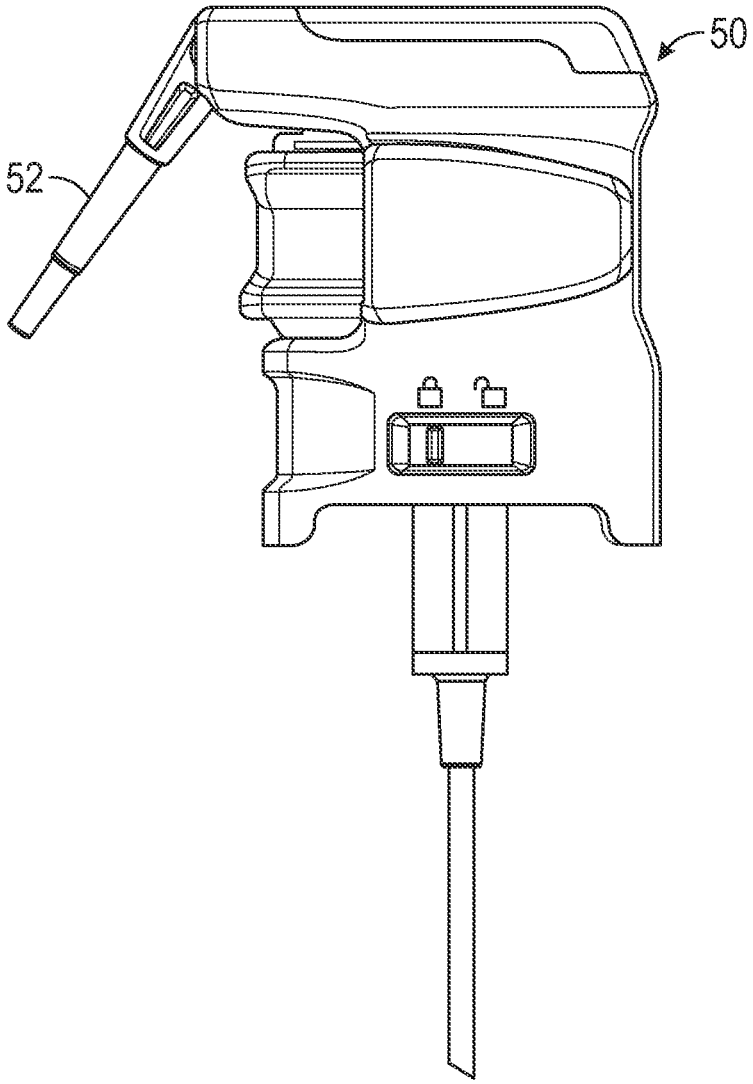
FIGS. 8A-8D are views of the pump nozzle of the progressive cavity pump of FIGS. 7A and 7B in various nozzle positions.
Figure 8B:
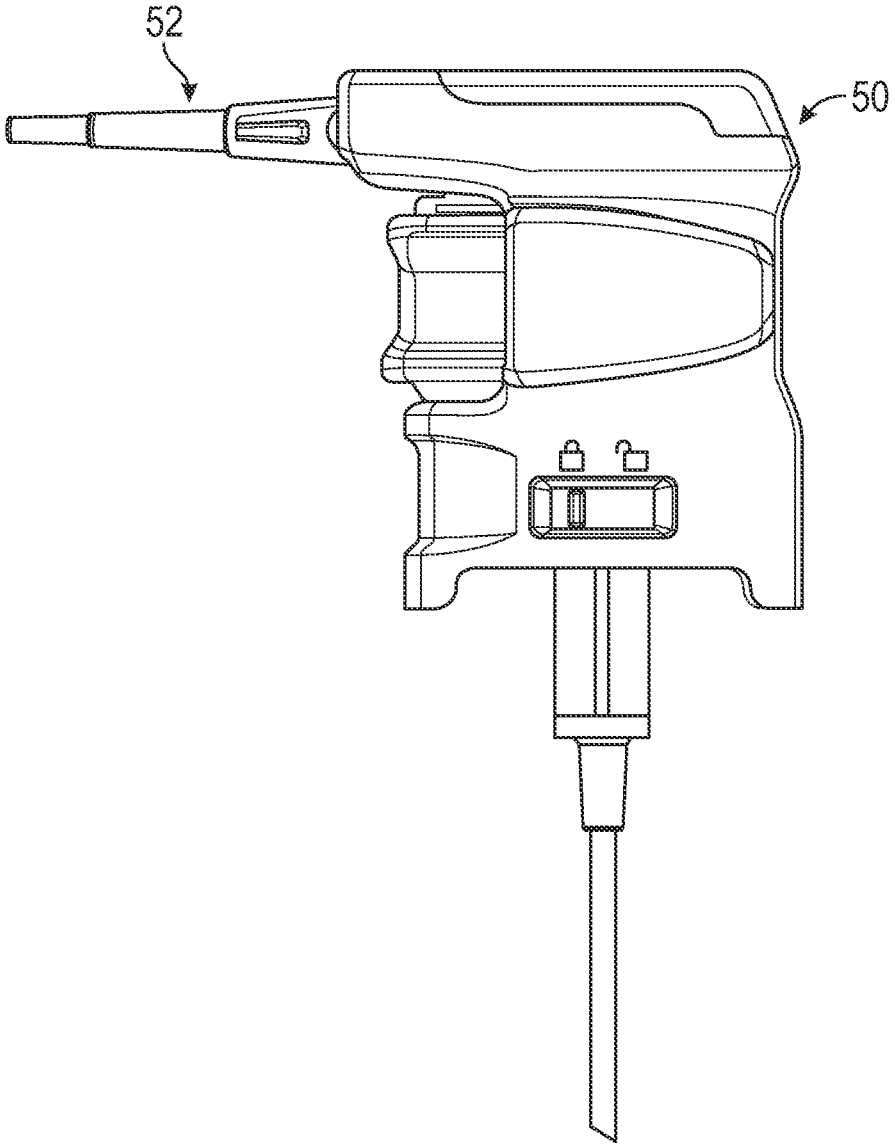
Figure 8C:
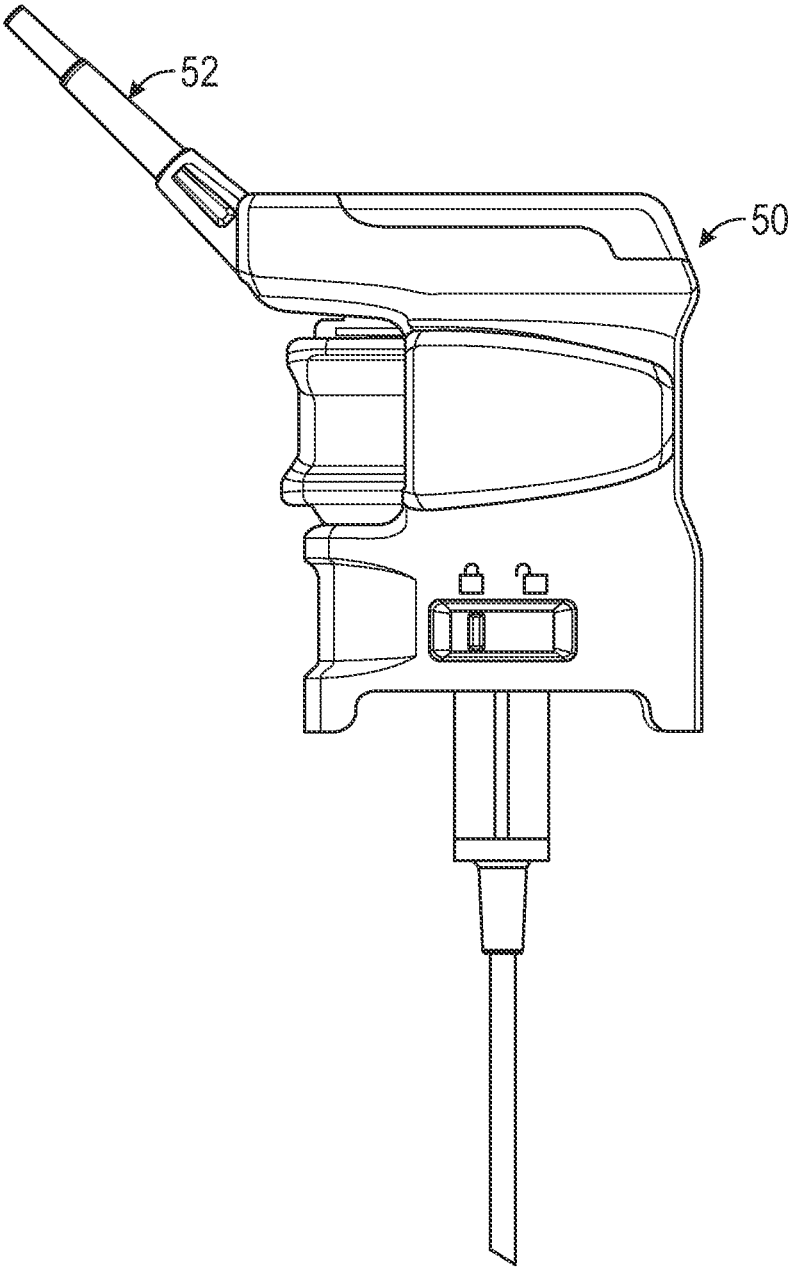
Figure 8D:
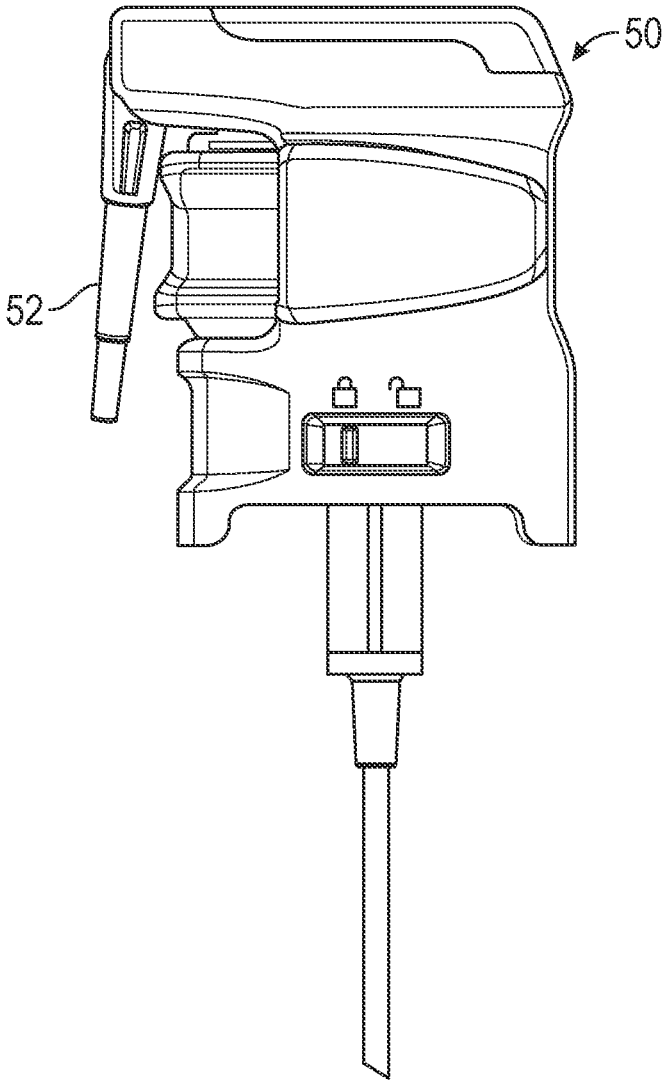

Referring to FIGS. 6-8, the nozzle assembly 52 is pivotably attached to the pump housing 50 and includes a nozzle body 92 extending from a nozzle attachment end 94 which attaches to the pump housing 50 to a nozzle dispensing end 96 which dispenses the liquid product 16 therefrom. The nozzle body 92 forms a nozzle cavity 98 therein to allow the upper tube 78 to extend therethrough. The nozzle body 92 also includes at least one finger fin 102 extending outwardly from the nozzle body 92. In the embodiment shown, two fins 102 are shown to extend outwardly. The nozzle attachment end 94 includes a nozzle attachment mechanism 104 for pivotably attaching the nozzle 92 to the pump housing 50, as shown in FIGS. 6, 7A and 7B. The attachment mechanism 104 includes a nozzle pivot feature 106 and a corresponding pump pivot feature 108 disposed on the pump housing 50 to allow the nozzle 92 to pivot about a nozzle pivot point 110. The attachment mechanism 104 also includes a plurality of grooves 112 to mate with a protrusion 114 formed on the pump housing 50. The grooves 112 are positioned and spaced to allow the nozzle 92 to pivot between several positions. For example, in one embodiment, the nozzle 92 has four (4) nozzle positions with each groove 112 corresponding to each position. The nozzle 92 has three (3) full flow positions with the nozzle 92 being disposed at substantially at 45°, 90°, and 135°, as shown in FIGS. 8A, 8B and 8C. The nozzle 92 also has a closed position with the nozzle pointing downwardly at substantially 0°, as shown in FIG. 8D.

In operation, the nozzle 92 is moved between the nozzle positions by moving the nozzle about the nozzle pivot point 110 into one of the nozzle positions. Once the nozzle is moved to the desired position, the groove 112 fits over the protrusion 114 and the nozzle is fixed in the desired nozzle position. The finger fins 102 can be used for ease of moving the nozzle 92 with one hand. In the full flow positions, the pump 10 is fully operational and the liquid product flow is not impinged as the upper tube 78 flexes to accommodate the nozzle position. The 45° and 135° positions are advantageous for harder to reach places.

Referring to FIGS. 5 and 6, the pump housing 50 also supports a locking assembly 120 for attaching the pump 10 to the bottle 12, 14 such that the pump housing 50 includes a locking opening 122, best seen in FIG. 6, formed therein to allow activation and deactivation of the locking assembly 120 by the pump operator for attaching and detaching the pump 10 from the bottle 12, 14. The pump housing 50 also supports a bottle seal 124 for sealing the liquid product 16 within the bottle while allowing air to pass therethrough.

Figure 9:
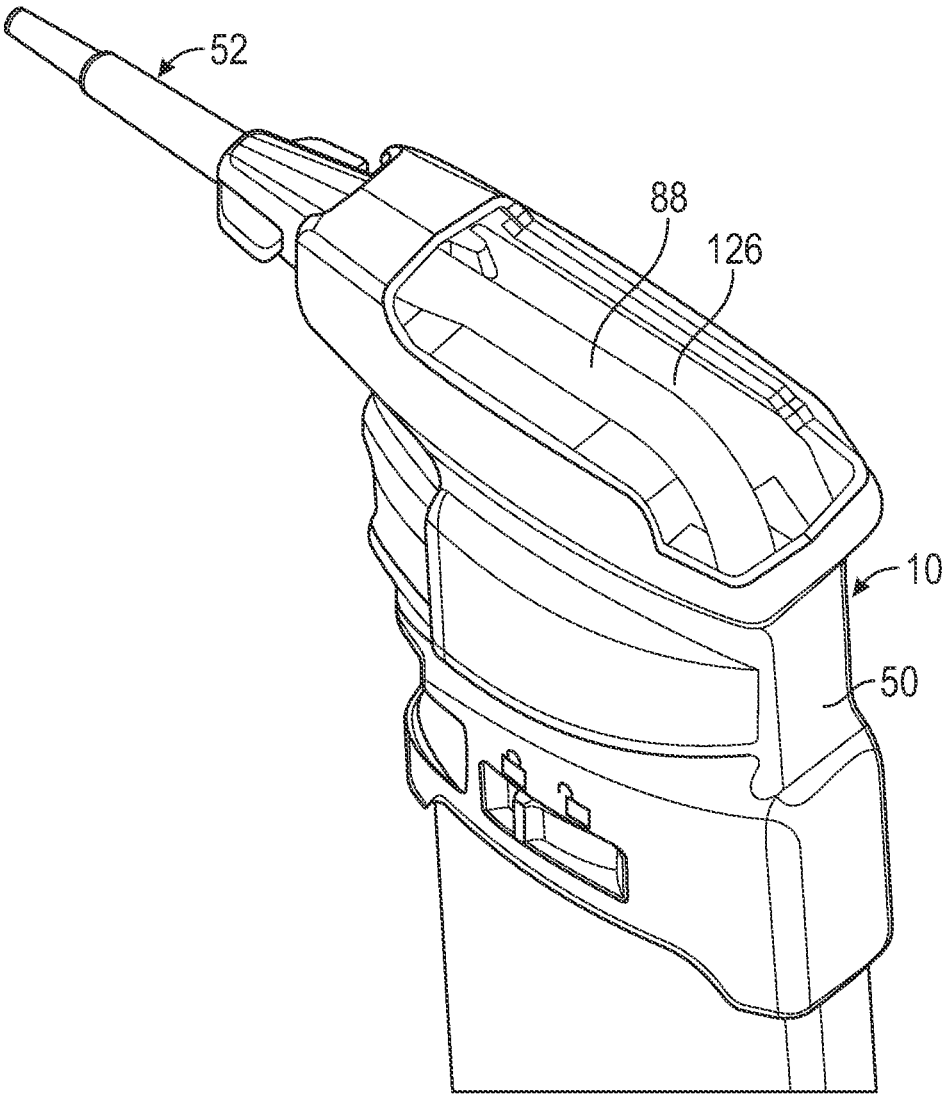
FIG. 9 is a top perspective view of the progressive cavity pump of FIG. 1 showing a top portion.

Referring to FIG. 9, the pump housing 50 also includes a top portion 126 disposed on the top portion of the pump 50 and fabricated from clear material to allow the operator to observe the upper tube 78 therethrough. The clear sight window formed by the top portion 126 allows the operator to monitor advance of the liquid product 16 during the pump-priming process.

Figure 10:
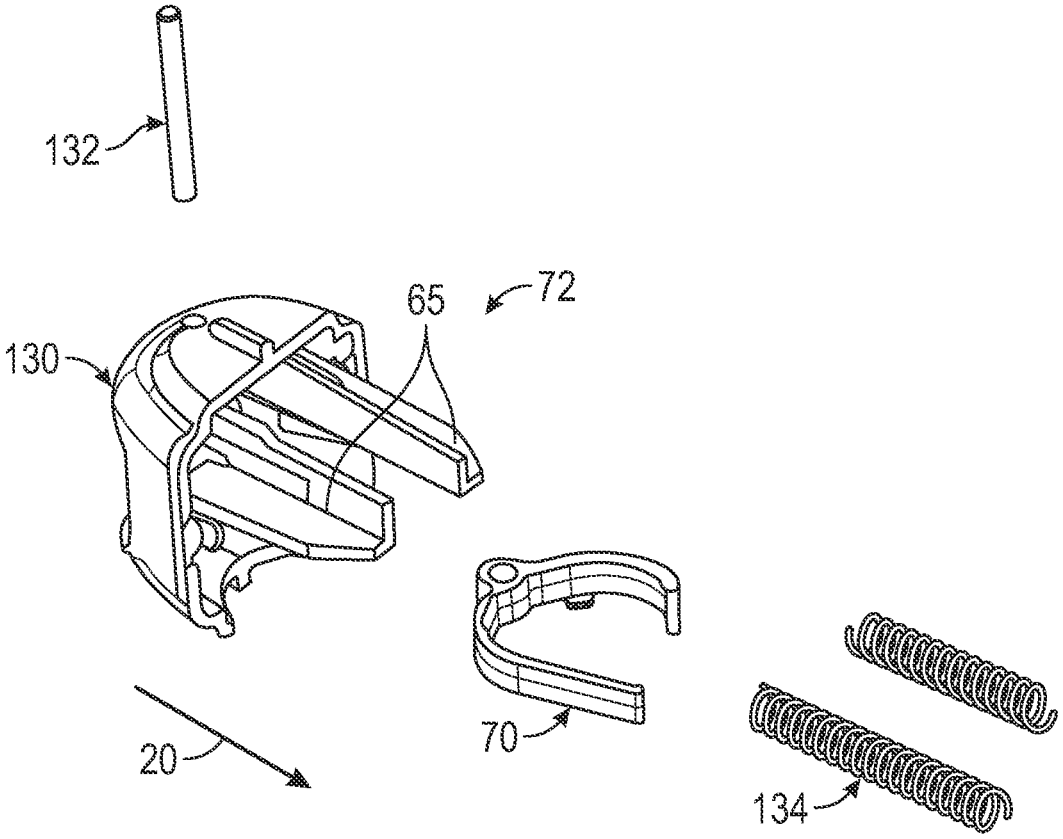
FIG. 10 is an exploded, perspective view of a trigger assembly of the progressive cavity pump of FIG. 1.
Figure 11:
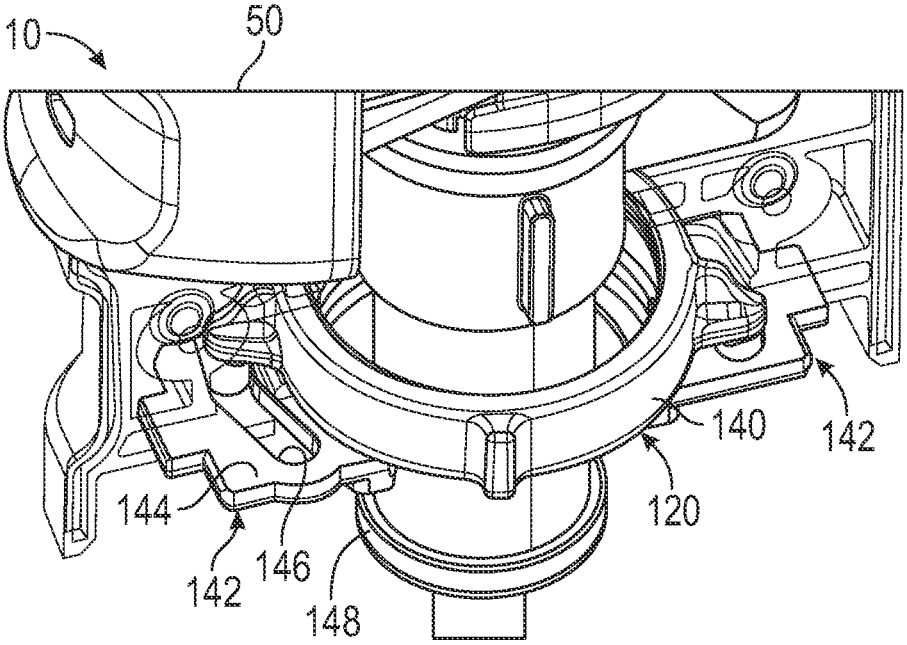
FIG. 11 is an enlarged, partial, top perspective view of a locking assembly of the progressive cavity pump of FIG. 1.
Figure 12:
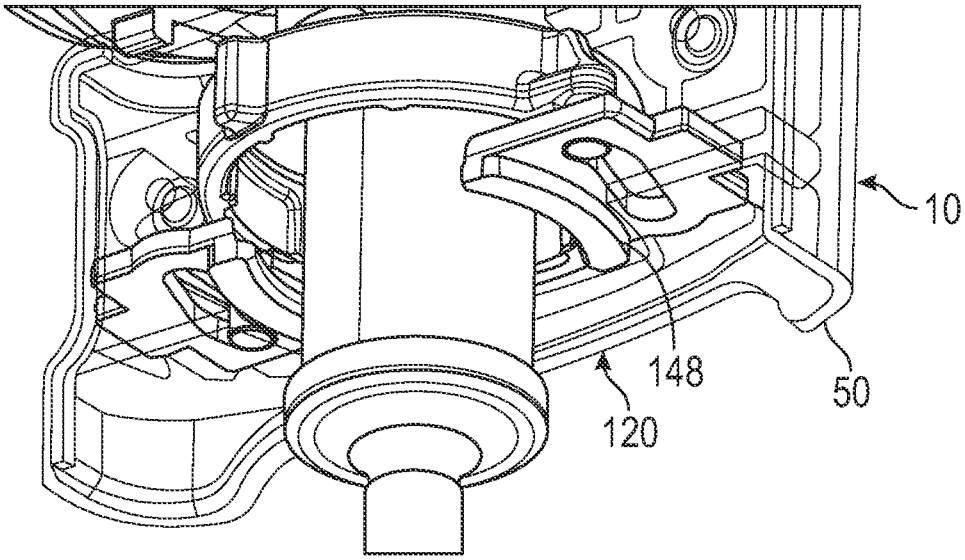
FIG. 12 is a bottom perspective view of the locking assembly of FIG. 11 of the progressive cavity pump.
Figure 13:
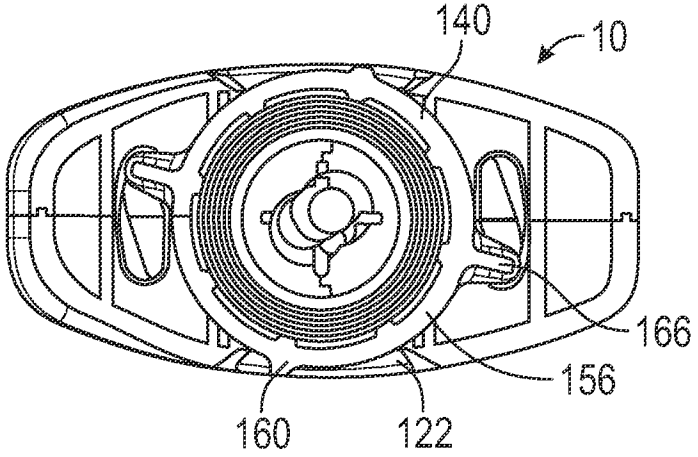
FIG. 13 is a sectional view of the locking assembly of FIG. 11 of the progressive cavity pump showing the lock ring in the locked position.
Figure 14:
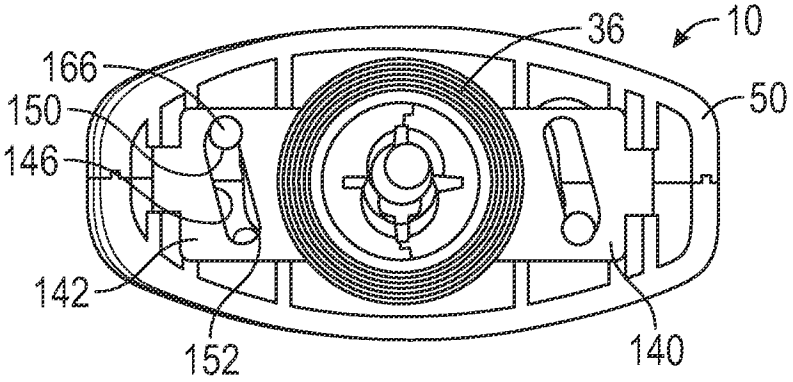
FIG. 14 is a sectional view of the locking assembly of FIG. 11 of the progressive cavity pump showing the lock bolts in the locked position.
Figure 15:
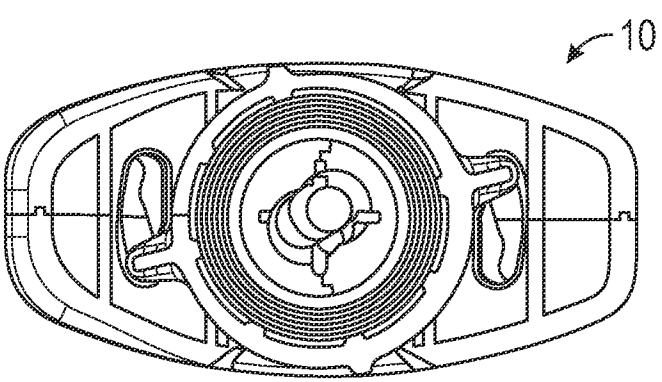
FIG. 15 is a sectional view of the locking assembly of FIG. 11 of the progressive cavity pump showing the lock ring in the unlocked position.
Figure 16:
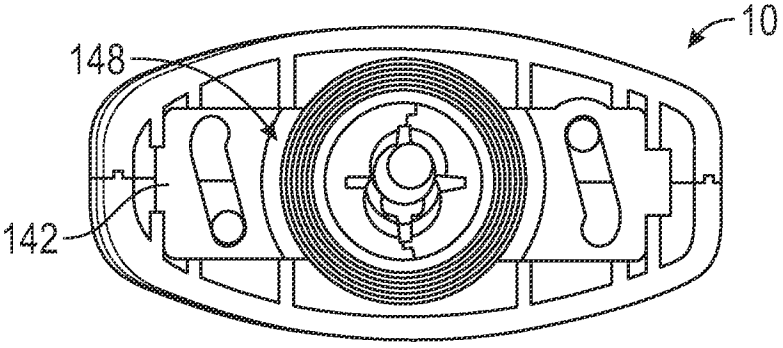
FIG. 16 is a sectional view of the locking assembly of FIG. 11 of the progressive cavity pump showing the lock bolts in the unlocked position.
Figure 17:
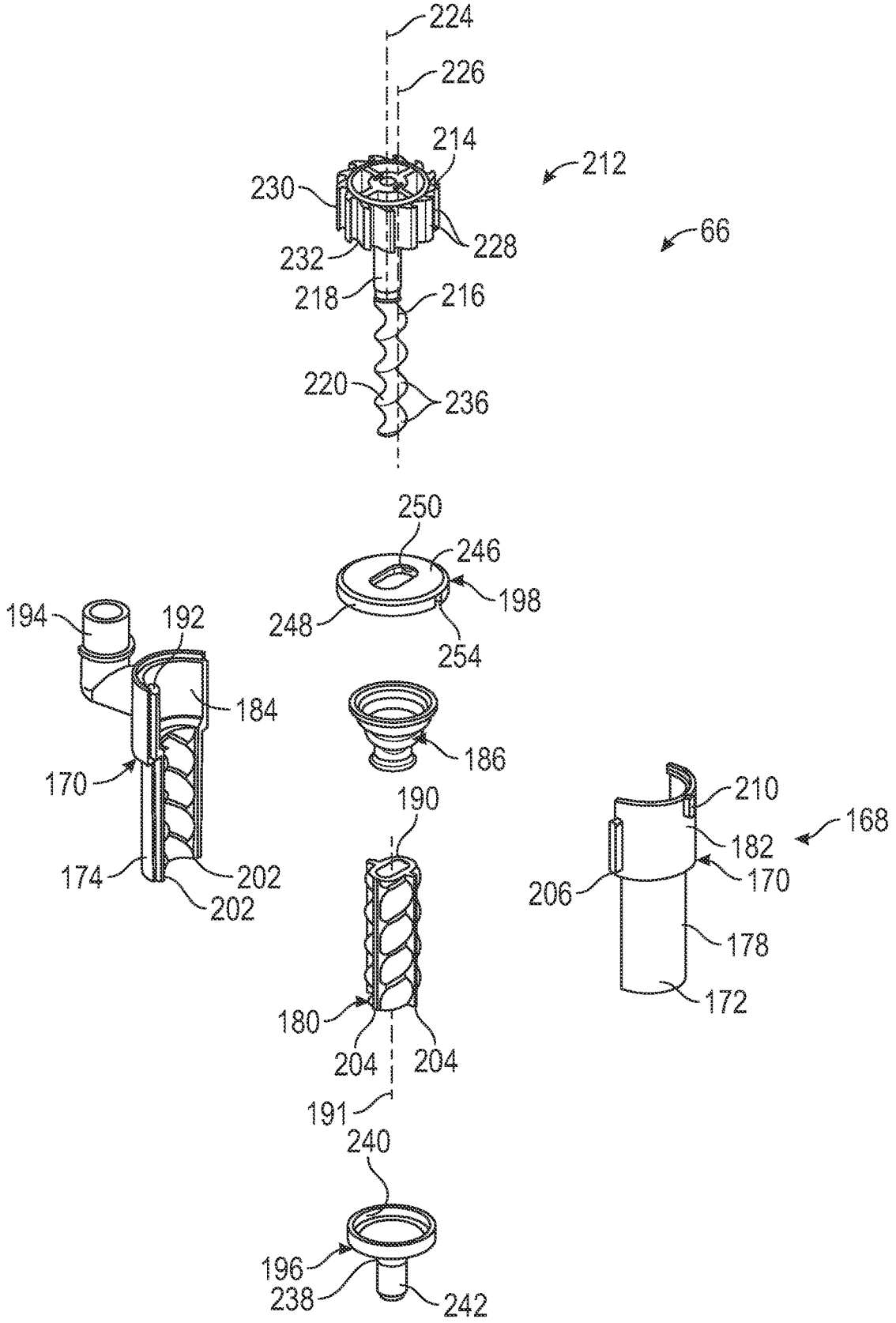
FIG. 17 is an exploded, perspective view of a progressive cavity pump assembly of the progressive cavity pump of FIG. 1.
Figure 18:
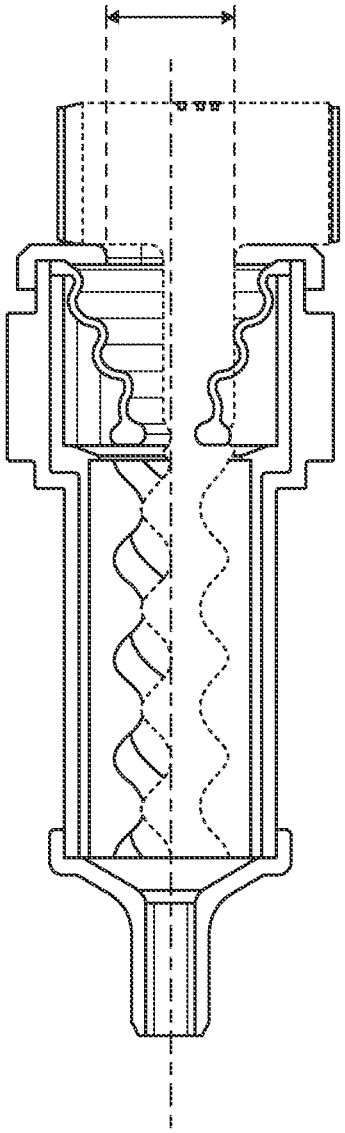
FIG. 18 is a sectional view of a progressive cavity pump assembly of the progressive cavity pump of FIG. 1.

Referring to FIGS. 4, 6 and 10, the trigger assembly 72 includes a trigger 130 accessible externally to be activated by the operator and a trigger pivot post 132 with a spring mechanism 134. The spring mechanism 134 allows the trigger assembly 72 to move in the longitudinal direction 20 with respect to the pump housing 50 to activate the pump 10. The spring mechanism 134 and the trigger pivot post 132 are supported by features 65 within the trigger assembly 72 to ensure proper operation thereof, as would be understood by those of ordinary skill in the art.

Referring back to FIGS. 4 and 5, the shoulder portion 60 of the pump housing 50 forms a shaped flange 136 extending downward from the pump housing 50 to cooperate with the bottle shoulder surface 34. The shaped flange 136 extends in the longitudinal direction 20 and includes flange extensions 138 to fit over and mate with the bottle shoulder surface 34. Referring back to FIG. 1, in the regular orientation position, the pump 10 fits over the bottle 12 such that the length of the pump 10 in the longitudinal direction 20 substantially corresponds to width 26 of the bottle 12 and the flange extensions 138 rest on the sides of the bottle shoulder surface 34. Referring back to FIG. 2, in the transverse orientation position, the pump 10 fits over the bottle 14 such that the length of the pump 10 in the longitudinal direction 20 corresponds to depth 28 of the bottle 14 and the flange extensions 138 rest on front and back of the bottle shoulder surface 34. Thus, the pump 10 of the same size can fit and be used with bottles of at least two sizes.

Referring to FIGS. 5, 6, and 11-16, the locking assembly 120 allows attachment and detachment of the pump 10 onto the bottle 12, 14 and includes a lock ring 140 and at least one lock bolt 142 cooperating with the lock ring 140. Each lock bolt 142 includes a lock bolt body 144 having a shaped cam opening 146 formed therein and a lock tab 148 extending therefrom. Each shaped cam opening 146 has a far end 150 and a close end 152. Each lock bolt 142 is movably supported by the pump housing 50 such that each lock bolt 142 is movable in the longitudinal direction 20 within the pump 10. The lock ring 140 includes a ring body 156 rotatably movable within the pump housing 50. The lock ring body 156 includes a switch portion 160 for protruding through the locking opening 122 formed within the pump housing 50 to allow the operator to attach and remove the pump 10 from the bottle 12, 14 by moving the switch portion 160 to one side or the other. The lock ring 140 also includes at least one lock pin 166 that fits into and cooperates with the shaped cam opening 146 of the lock bolt 142. The lock pin 166 is movable within the shaped cam opening 146 from the far end 150 to the close end 152 thereof. The locking assembly 120 has a locked position and an unlocked position, as best seen in FIGS. 13-16. In the unlocked position, the lock pin 166 of the lock ring 140 is disposed in the far end 150 of the shaped cam opening 146 of the lock bolt 142. In the unlocked position, the lock bolts 142 are farther apart and allow the pump 10 to fit over the neck 36 of the bottle 12, 14. In the locked position, the lock pin 166 of the lock ring 140 is disposed in the close end 152 of the shaped cam opening 146 of the lock bolt 142 and the lock bolts 142 are pushed closer together to engage the neck 36 of the bottle to secure the pump 10 onto the bottle 12, 14.

In operation, the pump 10 with the locking assembly 120 in the unlocked position is placed over the neck 36 portion of the bottle 12, 14. Once the pump 10 is placed over the neck of the bottle, in either longitudinal position or in transverse position, the operator can move the switch portion 160 of the locking assembly 120, accessible from the outside of the pump housing 50, from the unlocked position to the locked position. As the switch portion 160 is moved, the lock ring 140 rotates and the lock pins 166 slide within the shaped cam openings 146 of the lock bolts 142 from the far end 150 to the close end 152, thereby moving the lock bolts 142 from the unlocked position into the locked position so that the lock tab 148 of at least one lock bolt 142 fits under and engages the bead 44 of the bottle neck 36 and thus secures the pump 10 onto the bottle 12, 14.

Referring to FIGS. 4, 6,17 and 18, the progressive cavity pump assembly 66 is supported by the pump housing 50 and includes a stator 168 having a stator housing 170 which may have a first stator housing side 172 and a second stator housing side 174. The stator housing 170 forms a lower stator housing portion 178 for housing a stator insert 180 therein and an upper stator housing 182 forming a stator chamber 184 and for housing a flexible cone seal 186 therein. The lower stator housing 172 has internal lobed shape that corresponds to and supports the stator insert 180, which forms a shaped stator cavity 190 therein with a stator centerline 191. The upper stator housing 182 also has a stator opening 192 with a stator outlet pipe 194 extending therefrom. The progressive cavity pump assembly 66 also includes a stator housing inlet 196 to seal the lower stator housing 172 and a stator housing cap 198 to seal the upper stator housing 182. The stator housing 170 and the stator insert 180 include insert features 202, 204, respectively, that mate and fix the stator insert 180 within the stator housing 170. The stator housing 170 also includes external features 206 which correspond to the pump housing 50 internal features 65 for positioning the stator housing within the pump housing. The upper stator housing 182 further includes a cap protrusion 210.

Figure 19:
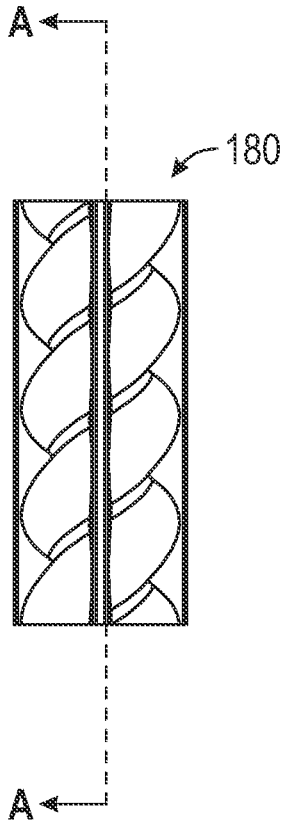
FIG. 19 is a front view of an insert of a stator of the progressive cavity pump assembly of the progressive cavity pump of FIG. 18.
Figure 20:
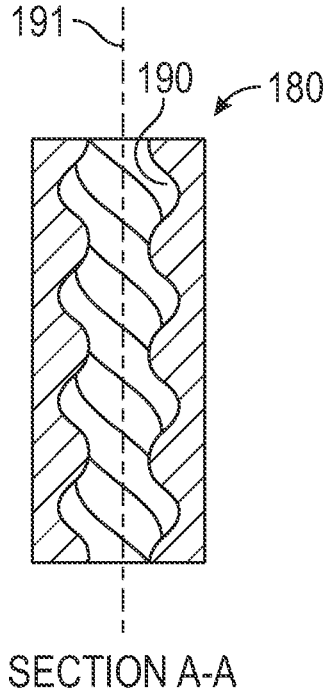
FIG. 20 is a cross-sectional view taken along A-A of the insert of FIG. 19.
Figure 21:
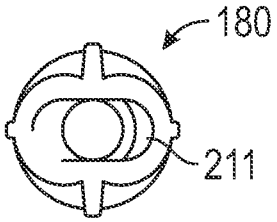
FIG. 21 is a top view of the insert of FIG. 19.
Figure 22:
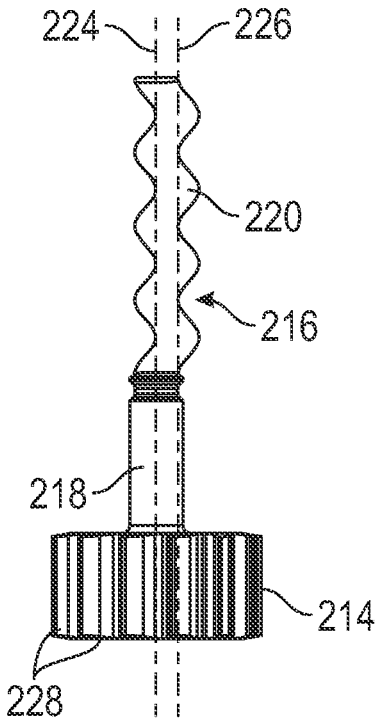
FIG. 22 is a front view of a rotor of the progressive cavity pump assembly of the progressive cavity pump of FIG. 18.
Figure 23:
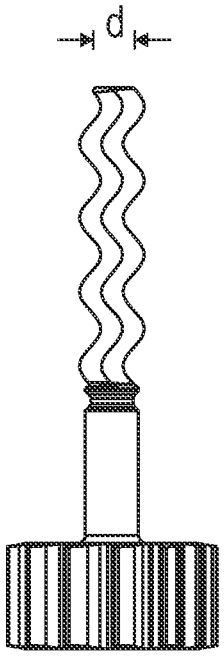
FIG. 23 is a side view of the rotor of FIG. 22.
Figure 24:
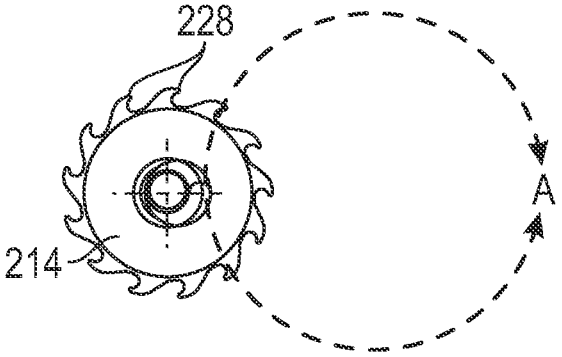
FIG. 24 is a bottom view of the rotor of FIG. 22.
Figure 25:
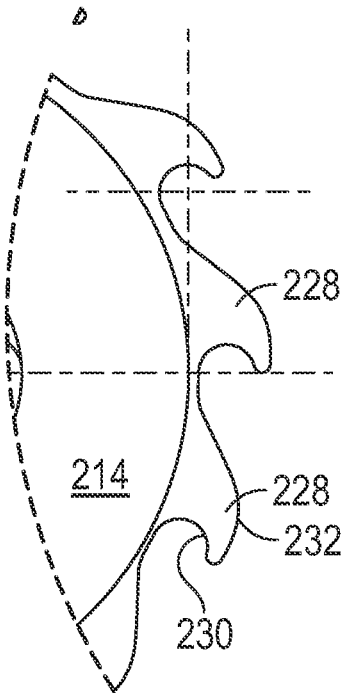
FIG. 25 is an enlarged, partial view of a gear portion of the rotor of FIG. 24.

Referring to FIGS. 19-21, the internal cavity 190 also defines an internal shape 211.

Referring to FIGS. 17 and 22-25, the progressive cavity pump assembly 66 further includes a rotor 212 which cooperates with the stator insert 180 to dispense the fluid product 16 from the bottle 12, 14 through the pump 10. The rotor 212 includes a gear portion 214 and a shaft 216 extending from the gear portion 214. The shaft 216 comprises a straight shaft portion 218 extending from the gear portion 214 and a lobed shaft portion 220 extending from the straight shaft portion 218. The gear portion and the straight shaft portion are substantially concentric and are centered about a gear center axis 224, whereas the lobed shaft portion 220 is centered about a lobed center axis 226, which is the axis of rotation of the rotor and which is offset from the gear center axis 224 by distance e. The gear portion 214 includes a plurality of teeth 228 extending radially outwardly therefrom with each tooth 228 having a tooth geometry and having an inner tooth surface 230 and an outer tooth surface 232. The straight shaft portion 218 includes a shaft diameter and the lobed shaft portion comprises a plurality of lobes shaped to cooperate with the stator insert 180 and has a cross-sectional diameter d.

Figure 26:
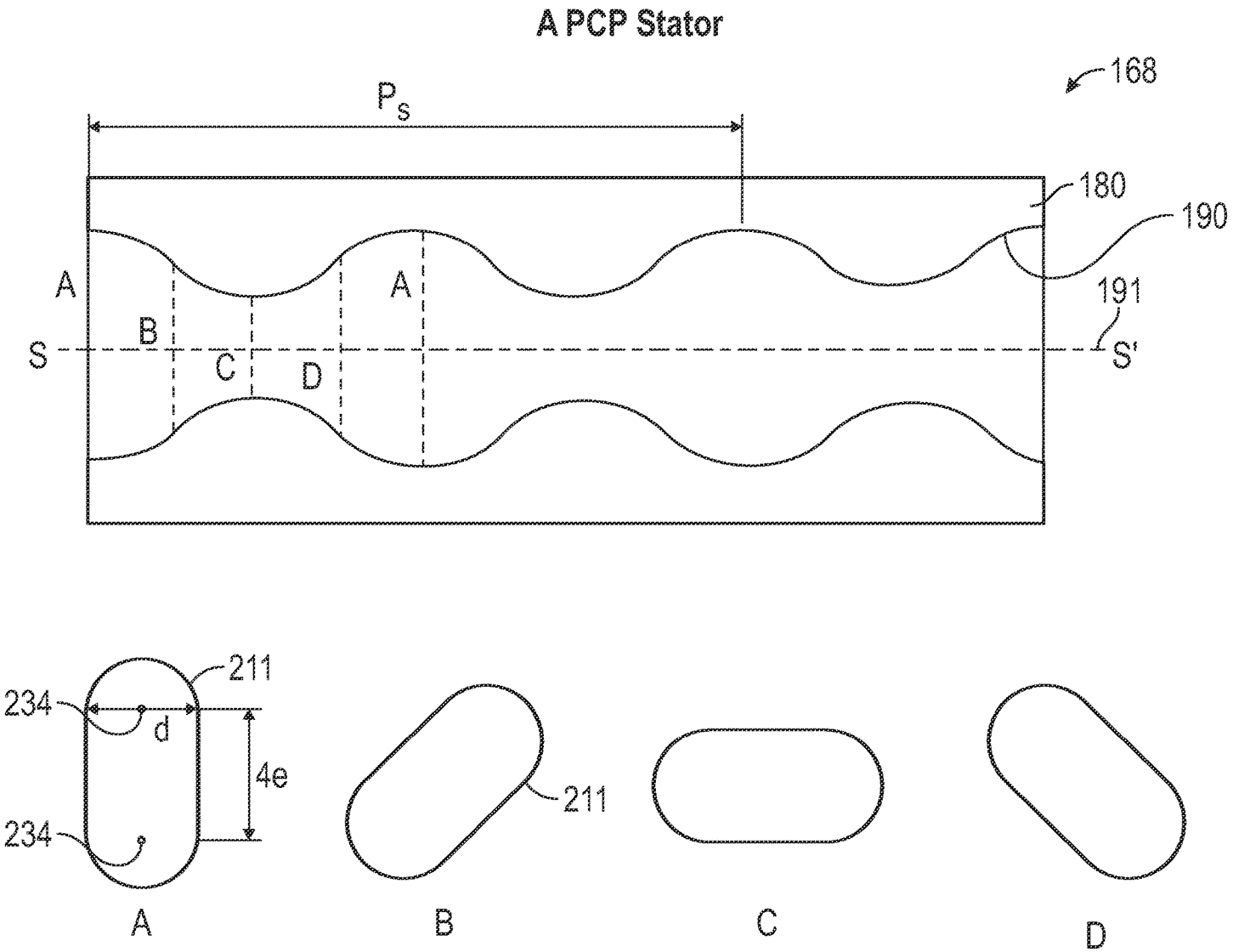
FIG. 26 is a schematic, cross-sectional view of the stator of FIG. 19 showing various cross-sections.
Figure 27:
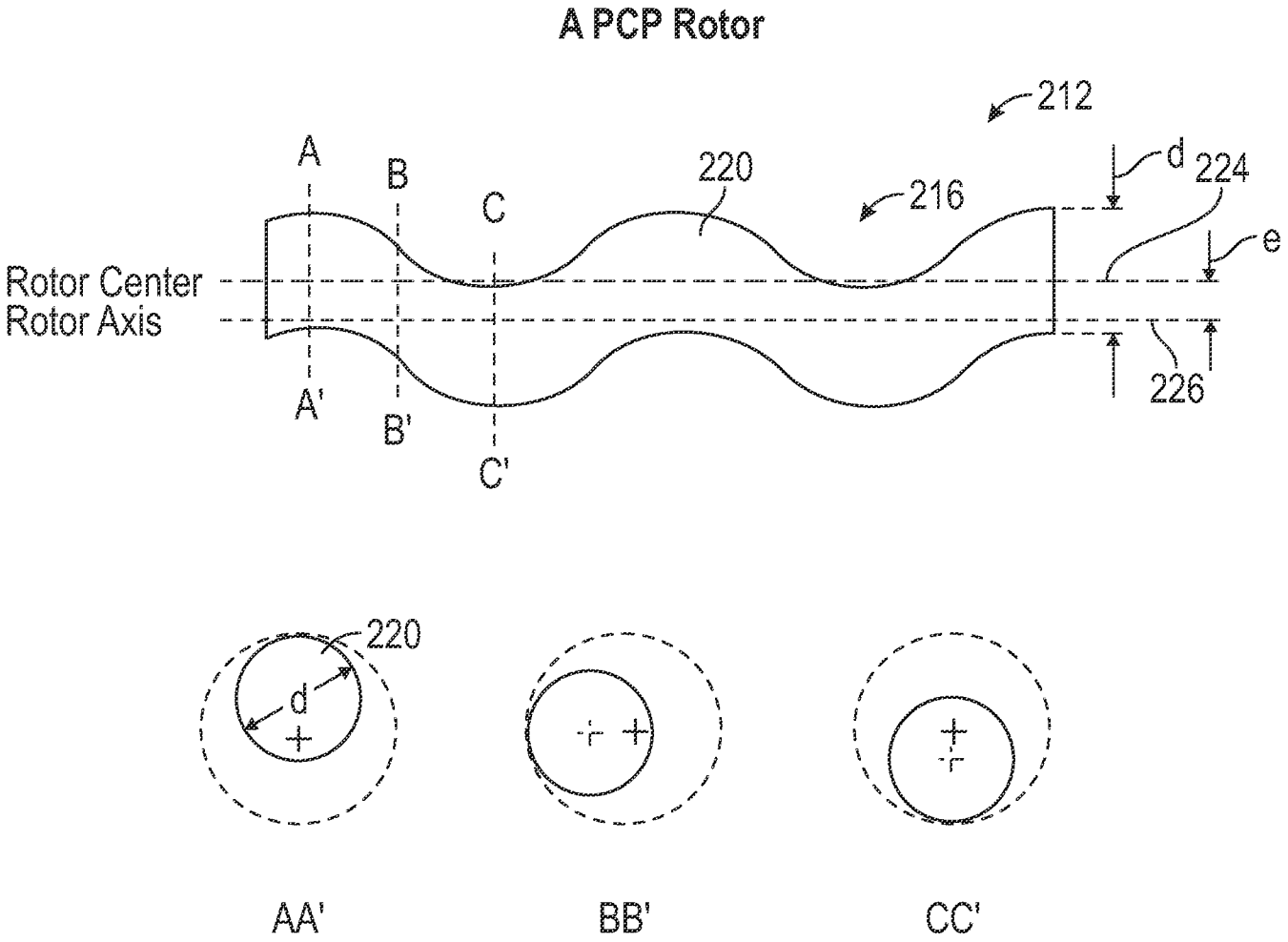
FIG. 27 is a schematic, partial, cross-sectional view of the rotor of FIG. 22 showing various cross-sections.
Figure 28:
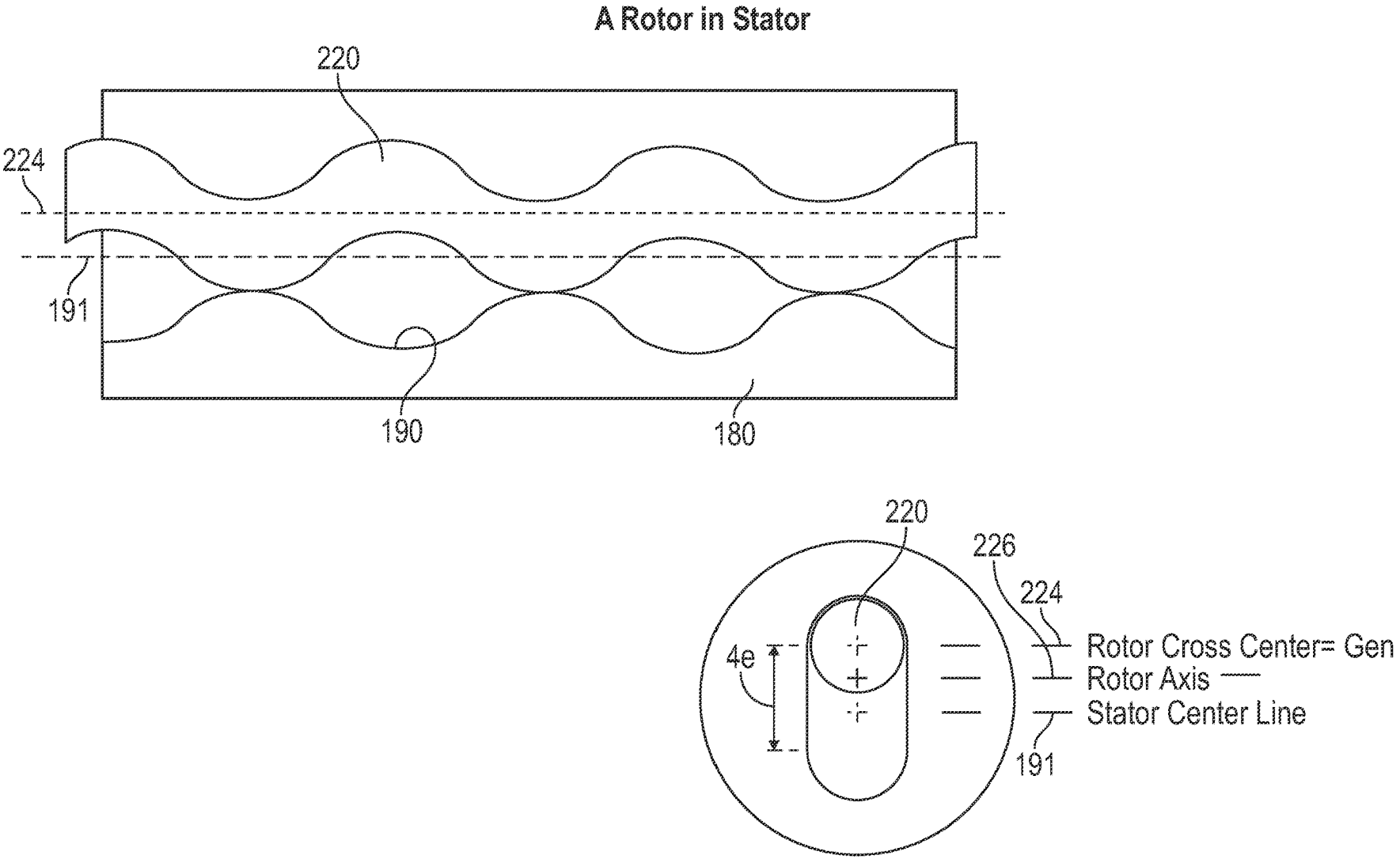
FIG. 28 is a schematic, cross-sectional view of the rotor and of the stator of FIGS. 19 and 22.

Referring to FIGS. 26-28, the internal shape 211 of the shaped stator cavity 190 is dimensioned to have width substantially equal to the diameter d, which is the cross-section of the lobed shaft portion 220. The length of the internal shape 211 of the shaped stator cavity 190 is equal to 4e between center points 234, wherein e is defined as the offset between the rotor center 224 and rotor axis 226.

Referring back to FIG. 17, the stator housing inlet 196 comprises a housing inlet body 238 having a disc shape with inlet body flange 240 extending upward and an inlet connector 242 extending downward. The inlet body flange 240 mates with the lower stator housing 172 to provide sealing and the inlet connector 242 is connected to the lower tube 76 to form the flow path and to allow the fluid product 16 to flow from the bottle into the pump.

The stator housing cap 198 includes a disc body 246 with a cap flange 248 extending downwardly therefrom and a cap slot 250 formed within the disc body 246. The cap slot 250 has a width and length with the width being substantially equal to the rotor shaft diameter d and the length of the cap slot being greater than the rotor shaft diameter. For example, for a double-pitched rotor, as shown in one embodiment, the length of the cap slot is equal to 4 times the distance e between the rotor center and the rotor axis, or 4e plus d. The width of the slot is sized to the rotor diameter d in such a way as to create a running fit or a slip fit. Thus, the cap 198 allows movement of the rotor 212 within the cap slot 246 in one direction and constraints the movement of the rotor shaft in the other direction. In the shown embodiment, the cap slot 246 allows the rotor shaft movement in the transverse direction 22. The disc flange 248 includes a notch 254 that cooperates with the cap protrusion 210 formed on the upper stator housing 182 for properly orienting the cap 198 with respect to the stator 168.

The flexible cone seal 186, disposed within the stator chamber 184 of the upper stator housing 182, has an approximately cone shape to provide a sealing mechanism to allow transverse movement of the rotor shaft 216 therein.

Figure 30:
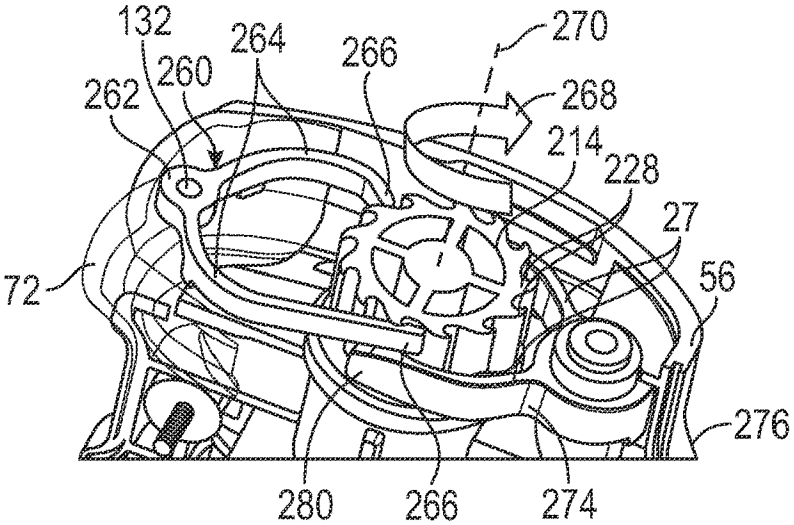
FIG. 30 is a partially broken away, sectional, top perspective view of the drive mechanism of the progressive cavity pump of FIG. 29.
Figure 31:
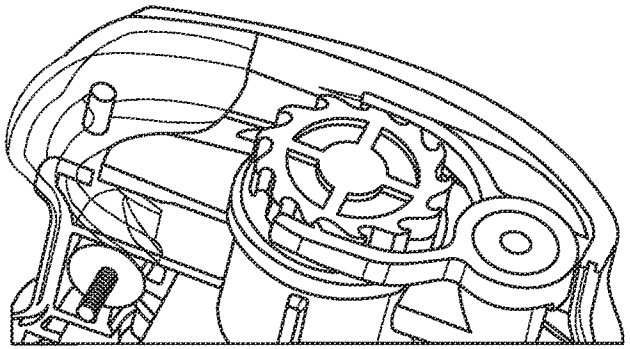
FIG. 31 is a partially broken away, sectional, top perspective view of the drive mechanism of the progressive cavity pump of FIG. 29.
Figure 29:
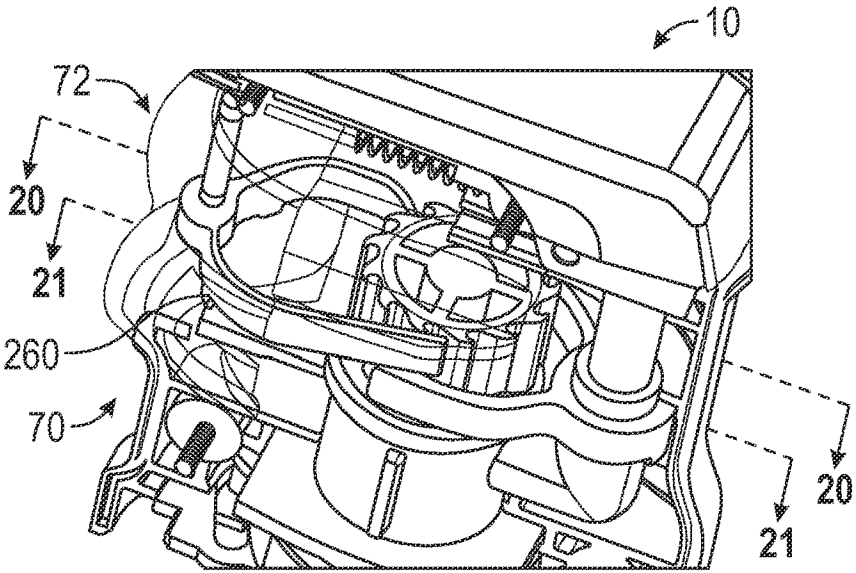
FIG. 29 is an enlarged, partially broken away, top perspective view of a drive mechanism of the progressive cavity pump of FIG. 1.
Figure 32:
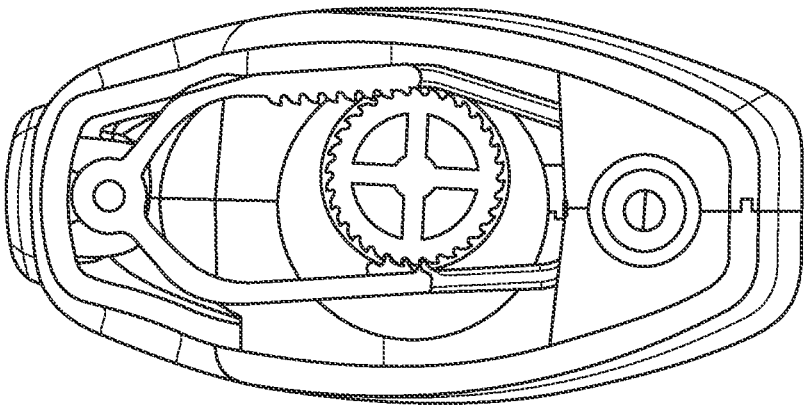
FIG. 32 is a sectional, top view of the drive mechanism of the progressive cavity pump of FIG. 4.
Figure 33:
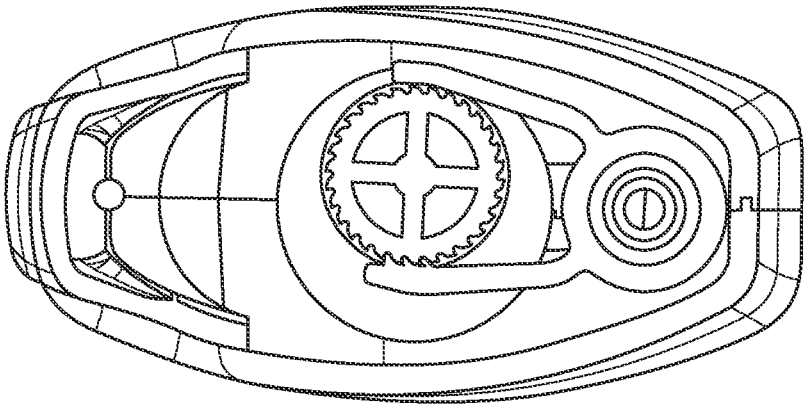
FIG. 33 is a sectional, top view of the drive mechanism of the progressive cavity pump of FIG. 4.

Referring to FIGS. 4 and 29-33, the drive mechanism 70 includes a forward drive yoke 260 having a pivot end 262 movably attaching to the trigger assembly 72 and forward drive arms 264 engaging the gear portion 214 of the rotor 212. Each forward drive arm 264 includes drive pawls 266 to engage the teeth 228 of the gear portion 214. The drive pawls 266 include drive pawls geometry to engage and mesh with the teeth 228 of the gear portion to drive the rotor 212 in a drive direction 268 about a drive axis 270, as best seen in FIG. 30. The pivot end 262 is coupled to the trigger pivot post 132 of the trigger assembly 72 which is activated when the trigger 130 is pulled.

The drive mechanism 70 also includes a rear yoke 274 disposed on the other side of the gear portion 214 and in a staggering relationship with the forward drive yoke 260. The rear yoke 274 includes a rear yoke pivot end 276 attaching to the pump housing 50 and rear yoke arms 278 extending outwardly and engaging the gear portion 214 of the rotor 212. Each rear yoke arm 278 includes rear pawls 280 having geometry to engage and mesh with the teeth 228 of the gear portion 214 to prevent reverse rotation of the gear portion 214 of the rotor 212.

The forward drive yoke 260 and the rear yoke 274 are arranged in a staggered configuration and dimensioned such that the forward drive yoke arms 264 and the rear yoke arms 278 engage the gear portion 214 of the rotor 212.

In operation, as the trigger 130 is pulled externally by the operator of the pump, the trigger moves in the longitudinal direction 20 via the spring mechanism 134 and activates the forward drive yoke 260 as the pivot end 262 of the forward drive yoke 260 is coupled to the trigger pivot post 132 of the trigger assembly 72. Once the forward drive yoke 260 is activated, it rotates the gear portion 214 of the rotor 212 in the drive direction 268. In one embodiment, the gear portion 214 is rotated approximately 90° in the drive direction 268 about the axis of rotation. The rear yoke 274 engages the gear portion 214 to preclude reverse rotation of the rotor by engaging the gear portion of the rotor. As the gear portion 214 is rotated about the axis of rotation, the rotor shaft is also rotated about axis of rotation. As the lobed shaft portion is rotated, the air (during priming) and then the liquid product are sucked into the stator chamber. As the gear portion is rotated and the lobed shaft portion rotatably moves within the stator chamber, the gear portion and the straight shaft also translate in the transverse direction. The straight shaft portion moves in the transverse direction 22 within the cap slot of the stator housing cap. Initially, the air and liquid product are moved into the lower tube, then enter the progressive cavity pump assembly through the stator housing inlet into the stator cavity wherein the air and/or liquid product are moved through the lobes as the gear portion of the rotor is driven by the drive mechanism.

With each pull of the trigger, the forward drive yoke drives the gear portion by turning the gear portion a predetermined rotation amount. As discussed above, in one embodiment, each trigger pull rotates the gear portion 90°. As the forward drive yoke 260 drives the rotor, the rear yoke 274 precludes the reverse motion. As such, the predetermined rotation amount and the geometry of the stator/rotor lobed portions determine the dozing amount and drop size per each trigger pull. As the gear portion 214 is rotated by the drive mechanism 70, the gear portion and straight shaft portion also translate in the transverse direction 22 as the lobed shaft portion moves along within the stator chamber. The air/liquid product then enter the stator chamber and exit the stator chamber through the stator opening into the stator outlet pipe and into the upper tube. The stator housing inlet, the flexible cone seal and the stator housing cap provide sealing and preclude the liquid product from escaping from the flow path. As the liquid product enters the upper tube, the liquid product follows its flow path and exits through the nozzle.

The progressive cavity pump 10 is able to operate with various types of liquid products, including, for example, products such as adhesives and glues and such. For example, the progressive cavity pump 10 is able to operate with products having viscosity of 1-3500 cP. The internal parts of the progressive cavity pump 10 are fabricated from materials compatible and capable of handling various products 16, including adhesives and glues.

Furthermore, the lower tube will be a rigid tube whereas the upper tube is flexible to allow for the nozzle 52 to be moved between the nozzle positions. Also, the flexible cone seal can be fabricated from a flexible elastomer such as silicone, whereas the cap with elongated slot is fabricated from a rigid plastic material.

Main advantages of the pump 10 are simplified design and compact size. Since the pump includes a rigid shaft, the pump does not require either universal joint or flexible shaft, which are prone to failure, therefore, eliminating potential for malfunction. The pump configuration also allows the pump stator to partially reside within the bottle, further allowing for the pump to be of a smaller dimension.

Another advantage of the pump 10 is that it may be used with at least two different sizes of the bottle. The pump can be secured in a longitudinal orientation position on a smaller sized bottle, as seen in FIG. 1, and in a transverse orientation position on a larger sized bottle, as seen in FIG. 2.

Further, the nozzle positions allow application of the liquid product to harder to reach places. Further, the nozzle can be moved with one hand and does not require both hands to operate. The upper tube 78 is fabricated from a material that allows flexing when the nozzle 92 is moved into different nozzle positions to allow full flow of the liquid product therethrough.

Additionally, the clear top allows the operator of the pump is able to monitor advance of the liquid product 16 during the pump-priming process.

Still further, the pump can be mounted onto a bottle without having to be screwed onto the bottle via threads.

Additionally, the pump allows dosing of specific amount of the liquid product per trigger pull, which is advantageous for many applications as compared to the continuous operation pumps.

Additionally, while the principles of the present disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A progressive cavity pump (10) comprising:

a pump housing (50); and a pump nozzle (52) pivotably attached to the pump housing (50) and having a nozzle body (92) including at least one finger fin (102) extending outwardly from the nozzle body (92);

wherein the at least one finger fin (102) allows operation of the pump nozzle (52) with one hand.

2. The progressive cavity pump according to claim 1 wherein the nozzle (52) has a plurality of full flow positions and a closed position.

3. The progressive cavity pump according to claim 2 wherein the plurality of full flow positions include the nozzle (52) being disposed at substantially at 45°, 90°, and 135°, and wherein in the closed position, the nozzle (52) is pointing downwardly at substantially 0°.

4. The progressive cavity pump according to claim 3 wherein an upper tube allowing liquid flow is flexible to allow for the nozzle (52) be moved between the nozzle positions.

5. A progressive cavity pump (10) comprising:

a pump housing (50) extending in a longitudinal direction (20) and a transverse direction (22), the pump housing forming a shoulder portion (60);

a pump nozzle (52) extending from the pump housing (50);

a progressive cavity pump assembly (66) driven by a drive mechanism (70);

a trigger assembly (72) to be engaged externally by an operator of the pump (10) to activate the drive mechanism (70) for advancing a liquid product (16) through the pump (10) via a flow path (74) for delivering the liquid product (16), the flow path being formed by a lower tube (76) extending from a bottle interior (46) into the pump (10), through the pump assembly (66) and through an upper tube (78) into the nozzle (52), the lower tube (76) including a lower tube inlet (82) open to intake the liquid product (16) and a lower tube outlet (84) for delivering the liquid product to the pump assembly (66), the upper tube (78) including an upper tube intake (86) connected to the pump assembly (66) and an upper tube outlet (88) disposed in the nozzle (52) for dispersing the liquid product (16) from the pump (10);

wherein the progressive cavity pump assembly (66) further includes a rotor (212) which cooperates with a stator (168) to dispense the fluid product (16) from the bottle (12, 14) through the pump (10) such that the pump allows dosing of specific amount of the liquid product per trigger pull;

wherein the stator (168) includes a stator insert (180) which cooperates with rotor (212) to dispense the fluid product (16) from the bottle (12, 14) through the pump (10);

wherein the rotor (212) includes a gear portion (214) and a shaft (216) extending from the gear portion (214);

wherein the shaft (216) comprises a straight shaft portion (218) extending from the gear portion (214) and a lobed shaft portion (220) extending from the straight shaft portion (218);

wherein the gear portion and the straight shaft portion are substantially concentric and are centered about a gear center axis (224), whereas the lobed shaft portion (220) is centered about a lobed center axis (226), which is the axis of rotation of the rotor and which is offset from the gear center axis (224) by distance e, the gear portion (214) includes a plurality of teeth (228) extending radially outwardly therefrom with each tooth (228) having a tooth geometry and having an inner tooth surface (230) and an outer tooth surface (232);

wherein the stator includes a stator housing cap (198) having a disc body (246) with a cap flange (248) extending downwardly therefrom and a cap slot (250) formed within the disc body (246); and wherein the cap (198) allows movement of the rotor (212) within the cap slot (250) in one direction and constraints the movement of the rotor shaft in the other direction.

6. A progressive cavity pump (10) comprising:

a pump housing (50) extending in a longitudinal direction (20) and a transverse direction (22), the pump housing forming a shoulder portion (60);

a pump nozzle (52) extending from the pump housing (50);

a progressive cavity pump assembly (66) driven by a drive mechanism (70);

a trigger assembly (72) to be engaged externally by an operator of the pump (10) to activate the drive mechanism (70) for advancing a liquid product (16) through the pump (10) via a flow path (74) for delivering the liquid product (16), the flow path being formed by a lower tube (76) extending from a bottle interior (46) into the pump (10), through the pump assembly (66) and through an upper tube (78) into the nozzle (52), the lower tube (76) including a lower tube inlet (82) open to intake the liquid product (16) and a lower tube outlet (84) for delivering the liquid product to the pump assembly (66), the upper tube (78) including an upper tube intake (86) connected to the pump assembly (66) and an upper tube outlet (88) disposed in the nozzle (52) for dispersing the liquid product (16) from the pump (10);

wherein the progressive cavity pump assembly (66) further includes a rotor (212) which cooperates with a stator (168) to dispense the fluid product (16) from the bottle (12, 14) through the pump (10) such that the pump allows dosing of specific amount of the liquid product per trigger pull;

wherein the drive mechanism (70) includes a forward drive yoke (260) and a rear yoke (274); and wherein the forward drive yoke (260) includes a pivot end (262) movably attaching to the trigger assembly (72) and forward drive arms (264) engaging the gear portion (214) of the rotor (212), each forward drive arm (264) includes drive pawls (266) to engage teeth (228) of the gear portion (214), the drive pawls (266) include drive pawls geometry to engage and mesh with the teeth (228) of the gear portion to drive the rotor (212) in a drive direction (268) about a drive axis (270), with the pivot end (262) being coupled to the trigger assembly (72) which is activated when a trigger (130) is pulled.

7. The progressive cavity pump according to claim 6 wherein the drive rear yoke (274) disposed on the other side of the gear portion (214) and in a staggering relationship with the forward drive yoke (260), the rear yoke (274) includes a rear yoke pivot end (276) attaching to the pump housing (50) and rear yoke arms (278) extending outwardly and engaging the gear portion (214) of the rotor (212), each rear yoke arm (278) includes rear pawls (280) having geometry to engage and mesh with the teeth (228) of the gear portion (214) to prevent reverse rotation of the gear portion (214) of the rotor (212).

8. The progressive cavity pump according to claim 7 wherein the forward drive yoke (260) and the rear yoke (274) are arranged in a staggered configuration and dimensioned such that the forward drive yoke arms (264) and the rear yoke arms (278) engage the gear portion (214) of the rotor (212).

* * * * *